US010478790B2

(12) United States Patent
Enomura

(10) Patent No.: US 10,478,790 B2
(45) Date of Patent: Nov. 19, 2019

(54) STIRRER PRODUCING INTERMITTENT JET FLOW

(71) Applicant: M. TECHNIQUE CO., LTD., Izumi-shi, Osaka (JP)

(72) Inventor: Masakazu Enomura, Izumi (JP)

(73) Assignee: M. TECHNIQUE CO., LTD., Izumi-Shi, Osaka (JP)

( * ) Notice: Subject to any disclaimer, the term of this patent is extended or adjusted under 35 U.S.C. 154(b) by 0 days.

(21) Appl. No.: 15/557,016

(22) PCT Filed: Mar. 23, 2016

(86) PCT No.: PCT/JP2016/059122
§ 371 (c)(1),
(2) Date: Sep. 8, 2017

(87) PCT Pub. No.: WO2016/152895
PCT Pub. Date: Sep. 29, 2016

(65) Prior Publication Data

US 2018/0056255 A1 Mar. 1, 2018

(30) Foreign Application Priority Data

Mar. 24, 2015 (JP) ..... 2015-061360

(51) Int. Cl.
*B01F 7/16* (2006.01)
*B01F 7/18* (2006.01)
(Continued)

(52) U.S. Cl.
CPC ..... *B01F 7/1625* (2013.01); *B01F 3/08* (2013.01); *B01F 3/0807* (2013.01);
(Continued)

(58) Field of Classification Search
CPC .. B01F 7/1625; B01F 7/00641; B01F 3/0807; B01F 5/0663; B01F 7/16; B01F 3/08;
(Continued)

(56) References Cited

U.S. PATENT DOCUMENTS 2,628,081 A * 2/1953 Laird ..... B01F 7/00641 165/109.1
3,195,867 A * 7/1965 Mould, Jr. ..... B01F 7/00758 241/244
(Continued)

FOREIGN PATENT DOCUMENTS

DE 1048465 B 1/1959
DE 1140440 B * 11/1962 ..... B01F 7/164
(Continued)

OTHER PUBLICATIONS

Machine Translation of FR 2679789 A1 Feb. 1993.*
(Continued)

*Primary Examiner* — Charles Cooley
(74) *Attorney, Agent, or Firm* — Birch, Stewart, Kolasch & Birch, LLP

(57) ABSTRACT

The problem of providing a stirrer capable of more effectively shearing a fluid to be treated is addressed, by using the action of an intermittent jet stream. A stirrer is provided with a rotor having a blade and a screen, which are relatively rotated such that the fluid to be treated is discharged from the inside of the screen to the outside as an intermittent jet stream through a slit in the screen, the stirrer satisfying condition 1 and condition 2. (Condition 1) the relationship among the width b in the rotating direction of a tip part of the blade, the width s in the circumferential direction of the slit, and the width t in the circumferential direction of the screen member is b≥2s+t. (Condition 2) the relationship between the width b in the rotating direction of the tip part
(Continued)

Figure 1:
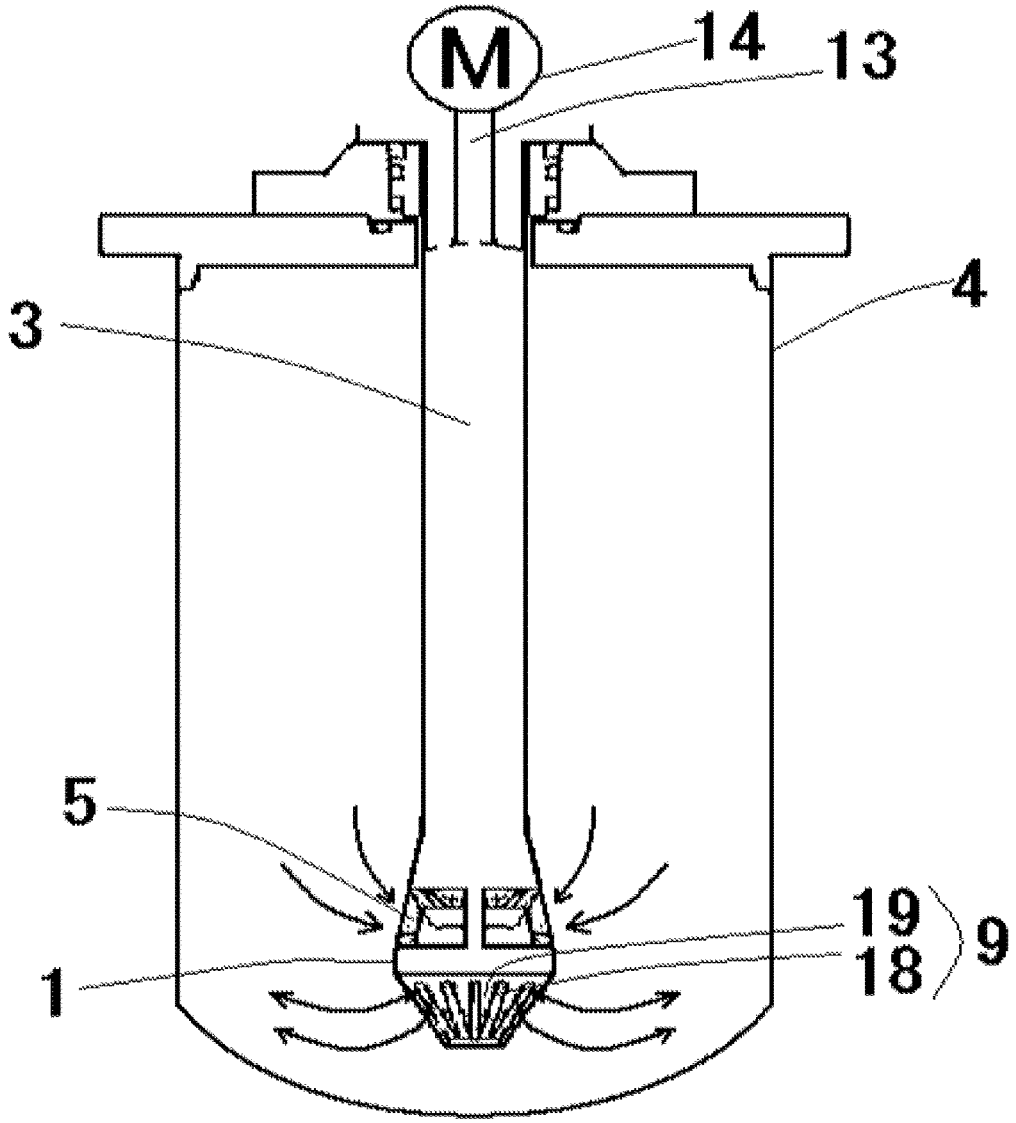

of the blade and the maximum inner diameter c of the screen is b≥0.1c.

16 Claims, 11 Drawing Sheets

(51) Int. Cl.
*B01F 3/08* (2006.01)
*B01F 5/06* (2006.01)
*B01F 7/00* (2006.01)

(52) U.S. Cl.
CPC ..... *B01F 5/0663* (2013.01); *B01F 7/00641* (2013.01); *B01F 7/16* (2013.01); *B01F 7/1635* (2013.01); *B01F 7/18* (2013.01); *B01F 2215/0409* (2013.01); *B01F 2215/0431* (2013.01)

(58) Field of Classification Search
CPC ..... B01F 7/18; B01F 2215/0431; B01F 2215/0409; B01F 7/00358; B01F 7/1635; B01F 7/1645; B01F 7/164; B01J 19/008; B01J 19/10; B01J 2219/0877
USPC ..... 366/264, 302, 304, 305
See application file for complete search history.

(56) References Cited

U.S. PATENT DOCUMENTS 4,347,004 A * 8/1982 Platts ..... B01F 5/104 366/137
9,925,503 B2 * 3/2018 Enomura ..... B01F 7/0085
9,962,666 B2 * 5/2018 Enomura ..... B01F 5/10
10,137,420 B2 * 11/2018 Luharuka ..... B01F 3/1221
2013/0215711 A1 * 8/2013 Kamiya ..... B01F 5/10 366/343
2013/0218348 A1 * 8/2013 Kamiya ..... B01F 5/104 700/275
2013/0226521 A1 * 8/2013 Kamiya ..... B01F 5/104 702/182
2014/0001663 A1 * 1/2014 Kuraki ..... B01F 7/00775 264/8
2014/0192614 A1 * 7/2014 Kamiya ..... B01F 5/10 366/302
2015/0321154 A1 * 11/2015 Enomura ..... B01F 5/10 366/302
2015/0328602 A1 * 11/2015 Enomura ..... B01F 7/0085 366/164.2
2017/0130358 A1 * 5/2017 Enomura ..... B82Y 40/00
2018/0056255 A1 * 3/2018 Enomura ..... B01F 7/16
2018/0186722 A1 * 7/2018 Enomura ..... B01J 19/00

FOREIGN PATENT DOCUMENTS

FR 2 679 789 A1 2/1993
FR 2679789 A1 * 2/1993 ..... B01F 7/164
GB 755913 A * 8/1956 ..... B01F 7/00758
JP 60-61028 * 4/1985
JP 7-96167 A 4/1995
JP 2813673 B2 10/1998
JP 3123556 B2 1/2001
JP 5147091 B1 2/2013

OTHER PUBLICATIONS

Machine Translation of DE 1140440 B Nov. 1962.*
International Search Report, issued in PCT/JP2016/059122, dated Jun. 21, 2016.
Extended European Search Report, dated Oct. 16, 2018, for European Application No. 16768798.7.

* cited by examiner

STIRRER PRODUCING INTERMITTENT JET FLOW

TECHNICAL FILED

The present invention relates to a stirrer, especially relates to improvement of a stirrer to be used for emulsification, dispersion, or mixing of a fluid to be processed.

BACKGROUND ART

Various stirrers have been proposed for emulsification, dispersion, or mixing of a fluid, and today it is requested that a fluid to be processed which contains a material having a small particle diameter such as a nanoparticle is processed sufficiently well.

For example, a bead mill and a homogenizer are known as examples among many stirrers widely known.

In a bead mill, however, performance deterioration due to destruction and damage of a crystal condition of particle's surface has been a problem. Another significant problem is that a foreign matter is generated. In a high pressure homogenizer, problems relating to stable operation and requirement of a significantly large energy are yet to be solved.

A rotary homogenizer has been used as a pre-mixer in the past; but this requires a finishing machine to accomplish dispersion and emulsification to a nanometer level.

(With Regard to Patent Documents)

In view of the above situation, inventors of the present invention proposed the stirrer shown in Patent Documents 1 to 3. This stirrer is equipped with a rotor having plural blades and a screen having plural slits which is arranged around the rotor. The rotor and the screen rotate relative to each other, whereby shearing a fluid to be processed in a very narrow space formed between the blades and the inner wall of the screen which has slits so that the fluid to be processed is discharged from inside the screen toward outside thereof through the slits as an intermittent jet flow.

In the stirrer like this, as shown in the columns of Background Art of Patent Document 2, the stirring condition thereof has been changed by adjusting the rotation number of the impeller (namely the rotor). In the invention according to Patent Document 2, the proposal was made as to the stirrer in which the clearance between the edge of the impeller and the inner wall of the screen can be selected arbitrarily, whereby intending to optimize the capacity improvement in accordance with the fluid to be processed. In Patent Document 3, by increasing the frequency Z (kHz) of the intermittent jet flow above specific value, it was found that the effect to make particles finer was drastically enhanced; and based on this finding, the invention could be completed as to the stirrer that enabled to make the particles finer in the region which could not be achieved by conventional stirrers.

In all of these Patent Documents, the inventions were made by changing the clearance between the screen and the inner wall or by changing the frequency Z (kHz) of the intermittent jet flow, wherein these changes were made under a certain condition of the width of the edge of the rotor's blade in a circumferential direction and the width of the slits in a circumferential direction (specifically, under the fixed condition where the both widths are almost the same or the width of the edge of the rotor's blade is slightly larger than the width of the slits).

From the development work having been made so far by the applicant of the present invention, it is known that emulsification, dispersion, or mixing can be made by a liquid-liquid shear force in the velocity interface generated by the intermittent jet flow; and thus, it is presumed that this liquid-liquid shear force can effectively act so as to realize refinement of a fluid to be processed, especially to realize very fine dispersion and emulsification such as nano-level dispersion and emulsification; however, the action thereof is not yet fully elucidated until today.

(Historical Aspect of the Present Invention)

Inventors of the present invention tried to realize finer dispersion or emulsification by facilitating refinement of a fluid to be processed by the device shown in Patent Documents 1 to 3. Firstly, because shearing of a fluid to be processed occurs in a minute clearance between the blade and the inner wall of the screen having slits, it was presumed that to increase the number of shearing per unit time is effective to increase efficiency of the shearing; and thus, investigation was carried out from the viewpoint to increase the number of shearing per unit time.

As the means to realize this, as shown in these Patent Documents, to change the number of rotor's rotation (circumferential rotation velocity of the blade's edge portion) is known; however, under the condition of constant rotor's rotation number (circumferential rotation velocity of the blade's edge portion), it is presumed that to increase the number of the slits by narrowing the slits' width or to increase the number of the rotor's blades is effective.

However, in the case of generating the intermittent jet flow, if the slit's width is made too wide, a pressure of the fluid to be processed that goes through the slit decreases, on the other hand, if the slit's width is made too narrow, a flow amount of the fluid to be processed that goes through the slit decreases; and thus, there is a fear that the intermittent jet flow may not be generated favorably. As a result, there is a limit in the method wherein the slit's width is made narrow so as to increase the number of slit.

On the other hand, in the case of studying to increase the number of the rotor's blade, if the number of the rotor's blade is increased with keeping the blade's width unchanged, the space volume among the blades decreases, resulting in decrease of the amount of the fluid to be processed that is ejected by the blade, thereby suggesting that in order to increase the number of the blade, narrowing of the blade's width may be effective. On the contrary to the expectation, however, when the test was conducted to increase the number of the blade with narrowing the blade's width, refinement of the fluid to be processed could not be facilitated.

Therefore, we focused not on the increase of the number of shearing per unit time but on the liquid-liquid shear force due to the intermittent jet flow; and thus, facilitation of refinement of the fluid to be processed was studied by increasing this shear force.

The result of the study of the generation mechanism of the liquid-liquid shear force due to this intermittent jet flow will be explained hereunder with referring to FIG. 6. When the blade 12 rotationally moves by rotation of the rotor, the pressure of the fluid to be processed increases in the front side of the rotational direction of the blade 12. With this, the fluid to be processed is ejected as the intermittent jet flow from the slit 18 which is located in the front side of the blade 12. As a result, the liquid-liquid shear force is generated between the fluid to be processed that is present outside the screen 9 and the fluid to be processed that is ejected as the intermittent jet flow. Accordingly, by increasing the flow rate of the intermittent jet flow to be ejected, the liquid-liquid shear force can be increased, but there is a mechanical limit to increase the rotation number of the rotor.

As a result of further study, it became clear that the pressure of the fluid to be processed is decreased in the back side of the rotational direction of the blade 12 so that it causes a phenomenon that the fluid to be processed is sucked from the slit 18 which is located in the back side thereof. As a result, the inventors reached the idea that outside the screen 9, the intermittent jet flow of the fluid to be processed from the slit 18 is not merely ejected to the fluid to be processed that is in a static state, but a forward flow and a backward flow (ejection flow and suction flow) are generated to cause the relative difference in the velocities in the interface of the both flows thereby generating the liquid-liquid shear force between the fluids to be processed.

On the basis of this idea, the conventional examples shown in FIG. 6(C) and FIG. 6(D) were reexamined; and it was found that the thickness of the blade 12 was made as thin as mechanically allowable and the width of the edge portion 21 thereof was set narrow in order to increase the space between the blades 12 and so forth. Therefore, it became clear that because of this, the cycle of the change between ejection and suction becomes short thereby causing frequent change thereof, but possibly, the fluid to be processed cannot fully follow the change of the state between ejection and suction.

PRIOR ART DOCUMENTS

Patent Document

Patent Document 1: Japanese Patent No. 2813673.
Patent Document 2: Japanese Patent No. 3123556.
Patent Document 3: Japanese Patent No. 5147091.

DISCLOSURE OF THE INVENTION

Problems to be Solved by the Invention

The present invention has an object to provide a stirrer with which the shear force can be applied to the fluid to be processed more efficiently by the action of the intermittent jet flow. Also, the present invention has an object to provide a stirrer with which as a result of this efficient shearing, very fine dispersion and emulsification such as nano-level dispersion and emulsification can be realized.

Means for Solving the Problems

The present invention was achieved as a result of the efforts to improve the stirrer, wherein the said efforts are made on the basis of a new idea to increase the relative difference in the velocities in the interface of a forward flow and a backward flow (ejection flow and suction flow from the slits) of the fluid to be processed, the said relative difference being generated by the intermittent jet flow. Specifically, the present invention could be completed by finding the relationship among the screen, the slit formed in the screen, the rotor's blade, and the blade's edge; with this relationship, the relative difference in the velocities of the forward and backward flows of the fluid to be processed can be increased.

Thus, the present invention is modifying a stirrer, comprising:

a rotor which is equipped with plural blades and a screen having plural slits which is arranged around the rotor, in which the blades and the slits have at least a matching region between them in the same position in the lengthwise direction of the rotation axis of the rotor, and a fluid to be processed is ejected as an intermittent jet flow through the slits from inside the screen to outside the screen by rotating at least the rotor of the rotor and the screen thereby the rotor and the screen rotating relatively each other.

The present invention provides the stirrer which can satisfy the condition 1 and the condition 2 shown below at the same time.

(Condition 1)

A relationship among a width (b) of the edge portion of the blade in a rotational direction, a width (s) of the slit in a circumferential direction, and a width (t) of the screen member in a circumferential direction in the matching region is shown by $b \geq 2s+t$.

(Condition 2)

A relationship between the width (b) of the edge portion of the blade in a rotational direction and a maximum inner diameter (c) of the screen in the matching region is shown by $b \geq 0.1c$.

As described above, in the conventional example shown in FIG. 6(C) and FIG. 6(D), there is a possibility that the fluid to be processed cannot fully follow the change of the state between ejection and suction. Inventors of the present invention focused on this aspect, and found that by stipulating the relationship among the blade (especially the edge portion thereof), the screen, and the slit so as to satisfy the condition 1 and the condition 2, the fluid to be processed can follow more quickly to the change of the state between ejection and suction thereby causing to increase the relative difference in the velocities in the interface of the forward flow and the backward flow of the fluid to be processed so that the generated liquid-liquid shear force can be increased as compared with the conventional examples. On the basis of this finding, the present invention could be completed.

The action of the present invention is not necessarily elucidated completely; however, with referring to FIG. 6(A) and FIG. 6(B), the action of the present invention that is presumed by the inventors of the present invention will be explained hereunder in more detail. In the stirrer of the present invention, because the edge portion of the blade 12 is made wide, a period during which the fluid to be processed becomes static between ejection and suction is generated so that the change of the state between ejection and suction takes place slowly; and as a result of it, the fluid to be processed can follow well to the movement of the blade 12 as well as to the change of opening and closing of the slit 18 that takes place with this movement. Because of this, the relative difference in the velocities in the interface of the forward flow and the backward flow (ejection flow and suction flow) of the fluid to be processed increases, so that the shear force generated between the fluids to be processed can be increased.

It is difficult to directly measure the velocities of the forward flow and the backward flow (ejection flow and suction flow) of the fluid to be processed; however, as shown in Examples described later, it was confirmed that in the stirrer of Examples of the present invention, refinement of the microparticles of the fluid to be processed could be clearly facilitated as compared with conventional stirrers.

In the present invention, the width of the slit in a circumferential direction can be changed so far as the intermittent jet flow can be generated; and thus, the width (s) of the slit in a circumferential direction is preferably in the range of 0.2 to 4.0 mm, while more preferably in the range of 0.5 to 2.0 mm.

Desirably the present invention is executed such that diameters of the blades and of the screen become smaller as departing from an introduction part through which the fluid to be processed is introduced into the screen toward outside in the axial direction.

Considering the relationship between the slit and the introduction port in the axial direction, the amount of the ejection from the slit near to the introduction part tends to increase, and on the contrary, the amount of the ejection from the slit far from the introduction part tends to decrease. Therefore, by configuring the diameters of the blade and screen so as to be shorter as moving more apart from the introduction part in the axial direction, the amount of ejection in the axial direction can be made even. By so doing, generation of cavitation can be suppressed so that mechanical troubles can be reduced.

When the plural slits are made to have the same width in the circumferential direction and be disposed with the same interval in the circumferential direction, the fluid to be processed can be processed under a more even condition in the circumferential direction. However, this does not preclude the use of plural slits having different widths, nor does preclude the embodiment of uneven intervals among the plural slits.

When the screen is made not to rotate, only the rotor's rotation number needs to be considered in individual controls. On the contrary, when the screen is made to rotate in the opposite direction to the rotor, this can make the stirrer suitable for very fine dispersion and emulsification such as nano-level dispersion and emulsification.

Meanwhile, the size of the blade may be changed variously so far as the condition 1 and the condition 2 are satisfied; however, if the space volume among the blades becomes too small, the throughput may decrease, so that it is preferable that total sum of the cross section area of the blades in the plane perpendicular to the rotor's rotation axis be smaller than the cross section area of the space inside the screen. Here, when the total sum of the cross section area of the blades in the plane perpendicular to the rotor's rotation axis is represented by Y in the following specific formulas 1 and 2, and the cross section area of the space inside the screen in the plane perpendicular to the rotor's rotation axis is represented by Z in the following specific formulas 1 and 2, it is preferable that Y and Z satisfy the specific formula 2. X in the specific formula 1 represents the cross section area perpendicular to the rotation axis in the region defined by the outer circumferential surface of the rotation axis and the inner circumferential surface of the screen. Also, X, Y, and Z are all in the matching region.

$$X-Y=Z \quad \text{(Specific Formula 1)}$$

$$Y<Z \quad \text{(Specific Formula 2)}$$

It is preferable that, of plural cross sections in the matching region, at least one cross section satisfy the specific formula 2, while more preferably all the cross sections satisfy the specific formula 2.

In addition, the present application may be regarded as follows. The present invention provides a stirrer comprising a rotating rotor provided with a plurality of blades and a screen arranged around the rotor, wherein the screen comprises a plurality of slits in a circumferential direction thereof as well as a screen member located between the slits that are located in a neighborhood to each other; an edge portion of the blade and the slit have a matching region where they are in the same position with each other in an axial direction of a rotation axis of the rotor; of the rotor and the screen, at least the rotor is rotated so as to relatively rotate the rotor and the screen thereby ejecting a fluid to be processed from inside the screen to outside thereof through the slit as an intermittent jet flow; and the stirrer satisfies following condition 1 and condition 2:

(Condition 1)

in the matching region, a relationship among a width (b) of the edge portion of the blade in a rotational direction, a width (s) of the slit in a circumferential direction, and a width (t) of the screen member in a circumferential direction is shown by $b \geq 2s+t$, and (Condition 2)

a relationship between the width (b) of the edge portion of the blade in a rotational direction and a maximum inner diameter (c) of the screen in the matching region is shown by $b \geq 0.1c$.

Advantages

In the present invention, as a result of further study on the intermittent jet flow, the stirrer which can apply the shear force to the fluid to be processed more efficiently by the action of the intermittent jet flow could be provided.

Further, the present invention has achieved to provide a stirrer with which extremely fine dispersion and emulsification such as nano-dispersion and nano-emulsification can be realized successfully, as a result of the efficient shearing. Furthermore, the stirrer which can produce particles having a narrow particle size distribution with uniform particle diameter could be provided.

FIG. 1 This is the front view showing the state how the stirrer of the present invention is used.

Figure 2:
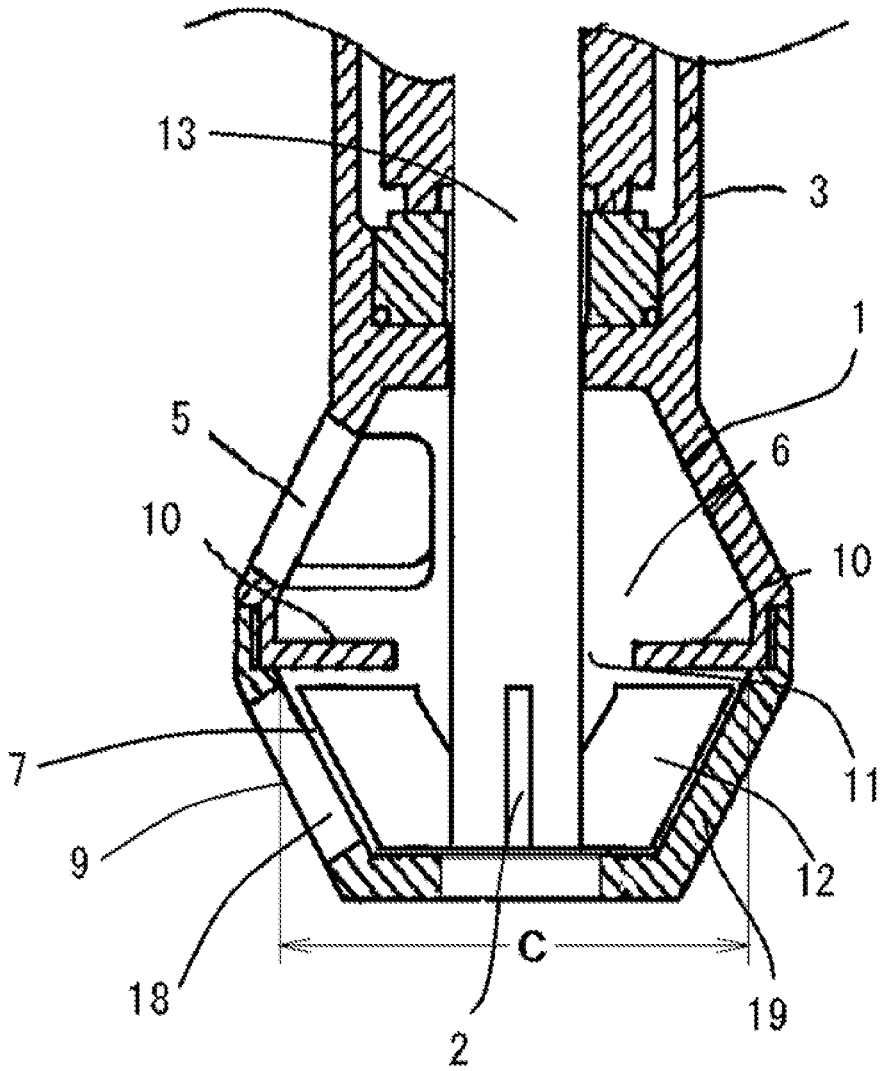

FIG. 2 This is the enlarged vertical sectional view of the essential part of the said stirrer.

Figure 3:
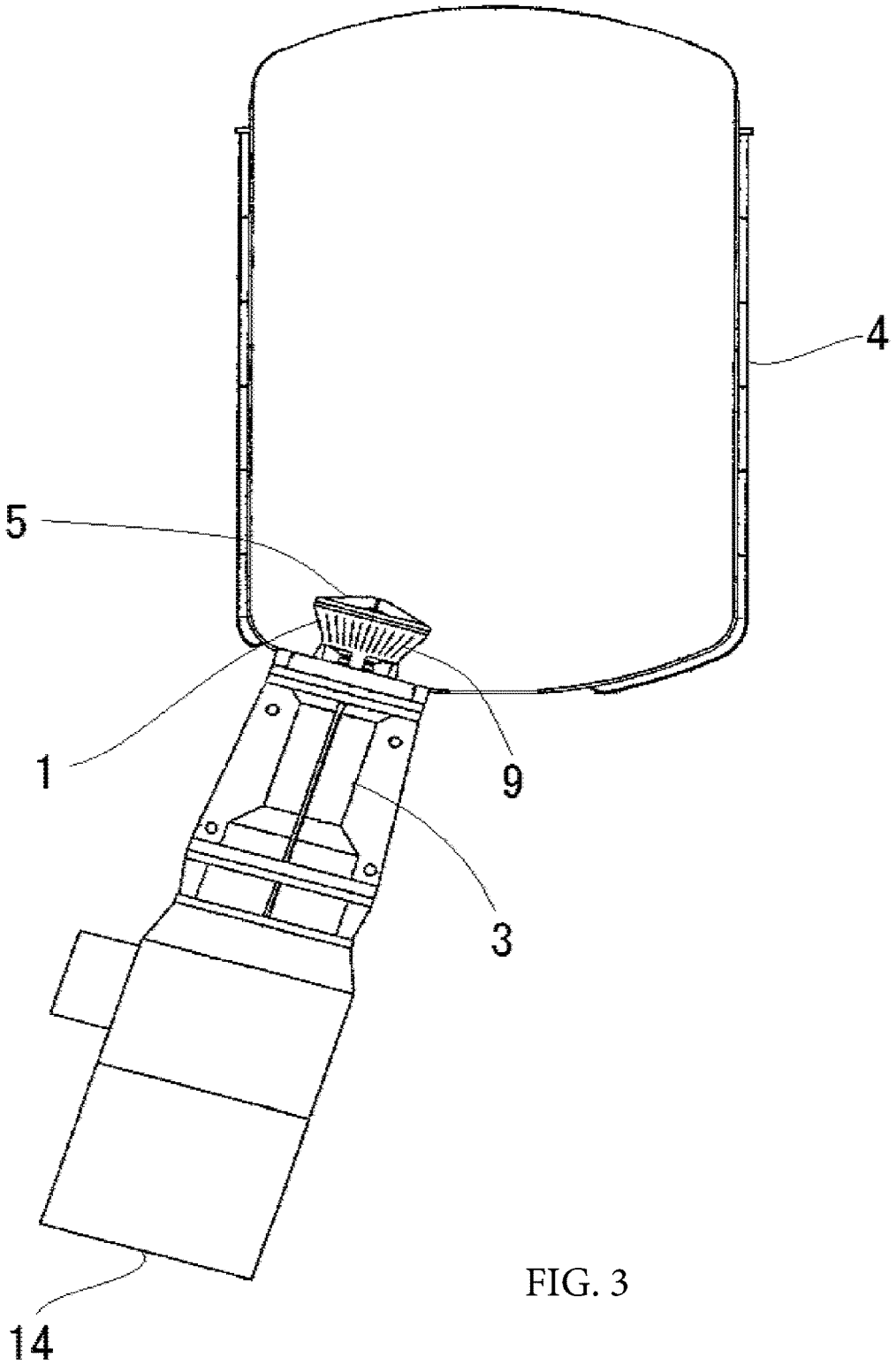

FIG. 3 This is the front view showing the state how the stirrer of other embodiment of the present invention is used.

Figure 4:
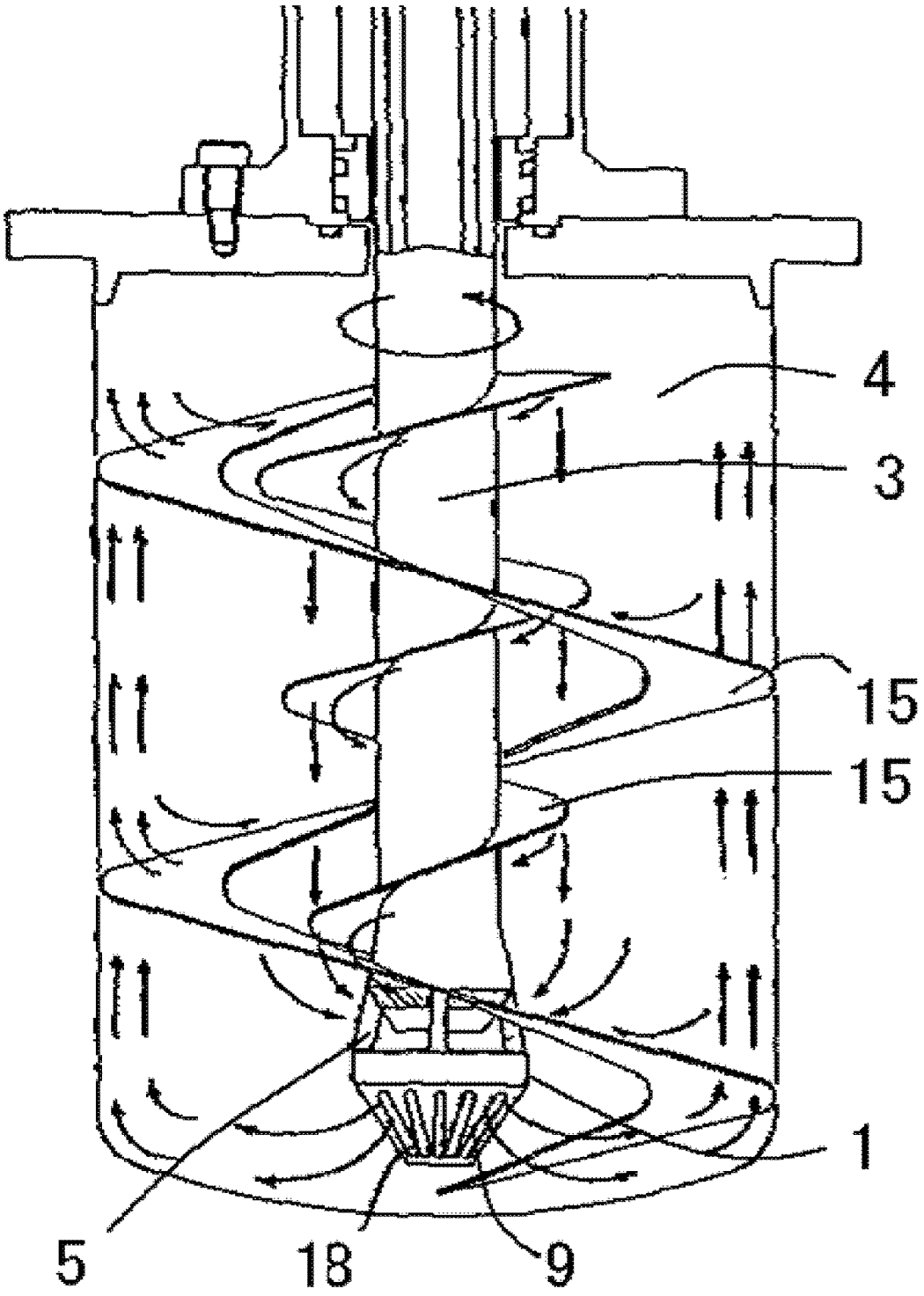

FIG. 4 This is the front view showing the state how the stirrer of still other embodiment of the present invention is used.

Figure 5:
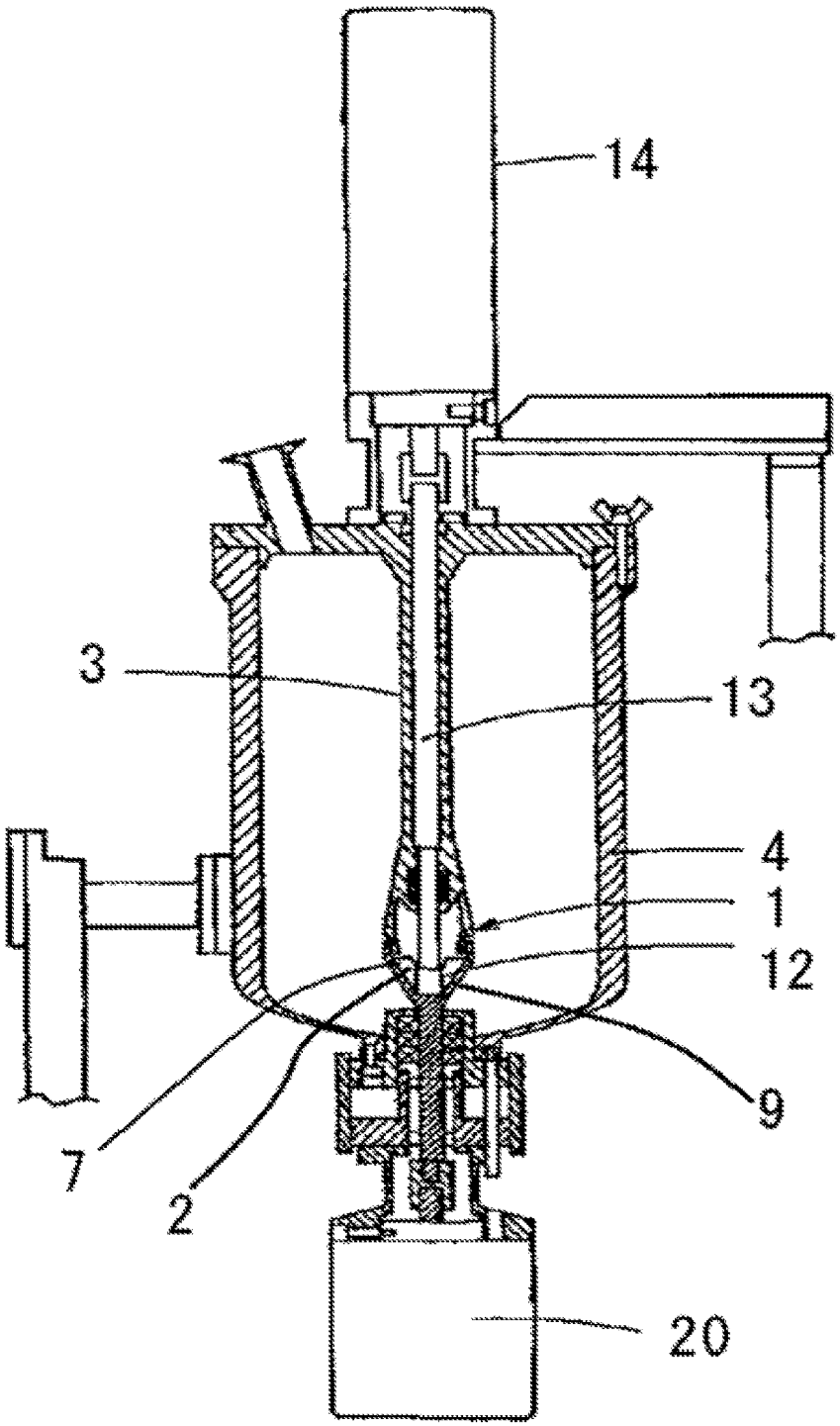

FIG. 5 This is the front view showing the state how the stirrer of still other embodiment of the present invention is used.

Figure 6:
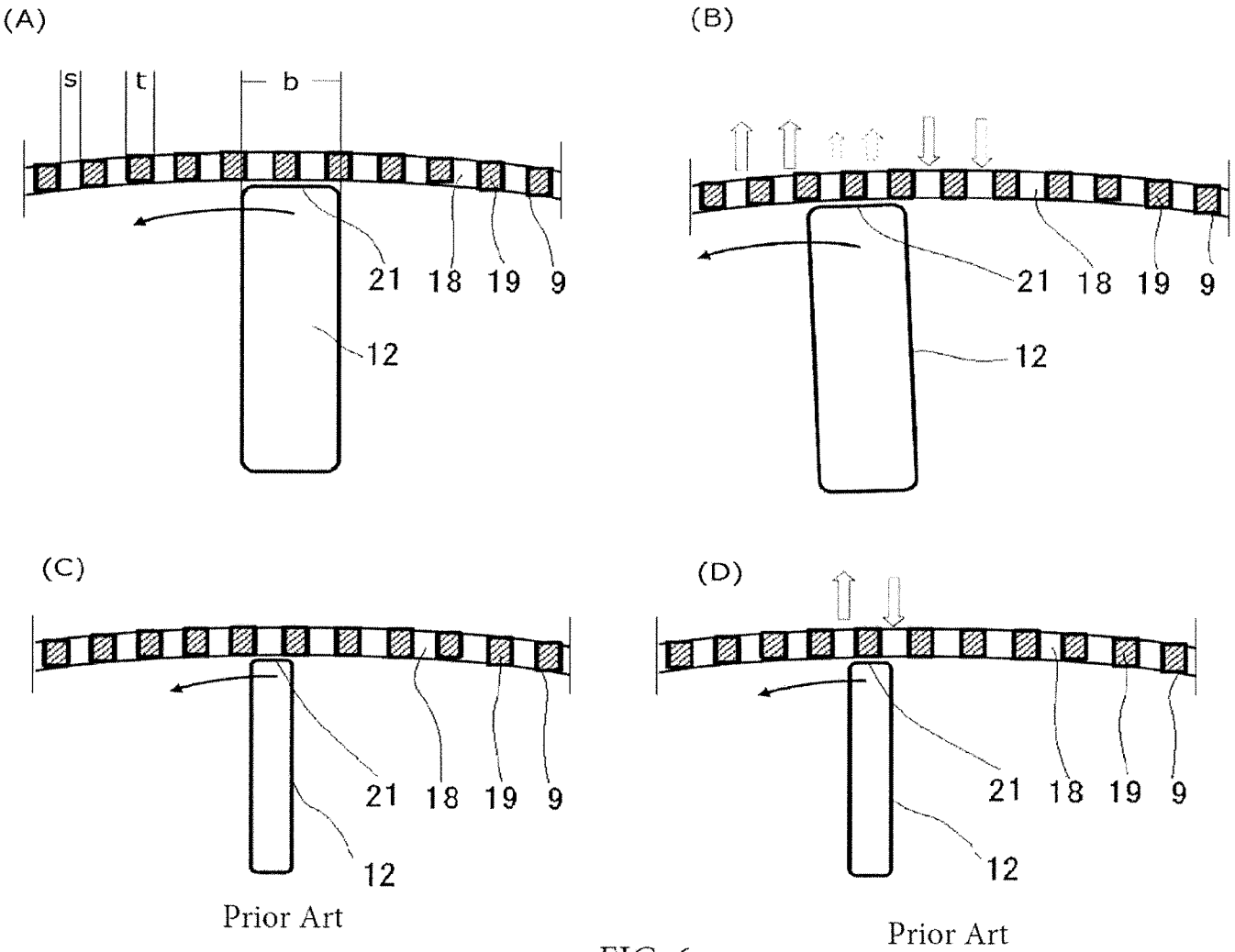

FIG. 6 (A) is an enlarged view of the essential part of the stirrer according to the embodiment applied with the present invention; (B) is an enlarged view of the essential part showing this action; (C) is an enlarged view of the essential part of the stirrer according to a conventional example; and (D) is an enlarged view of the essential part showing this action.

Figure 7:
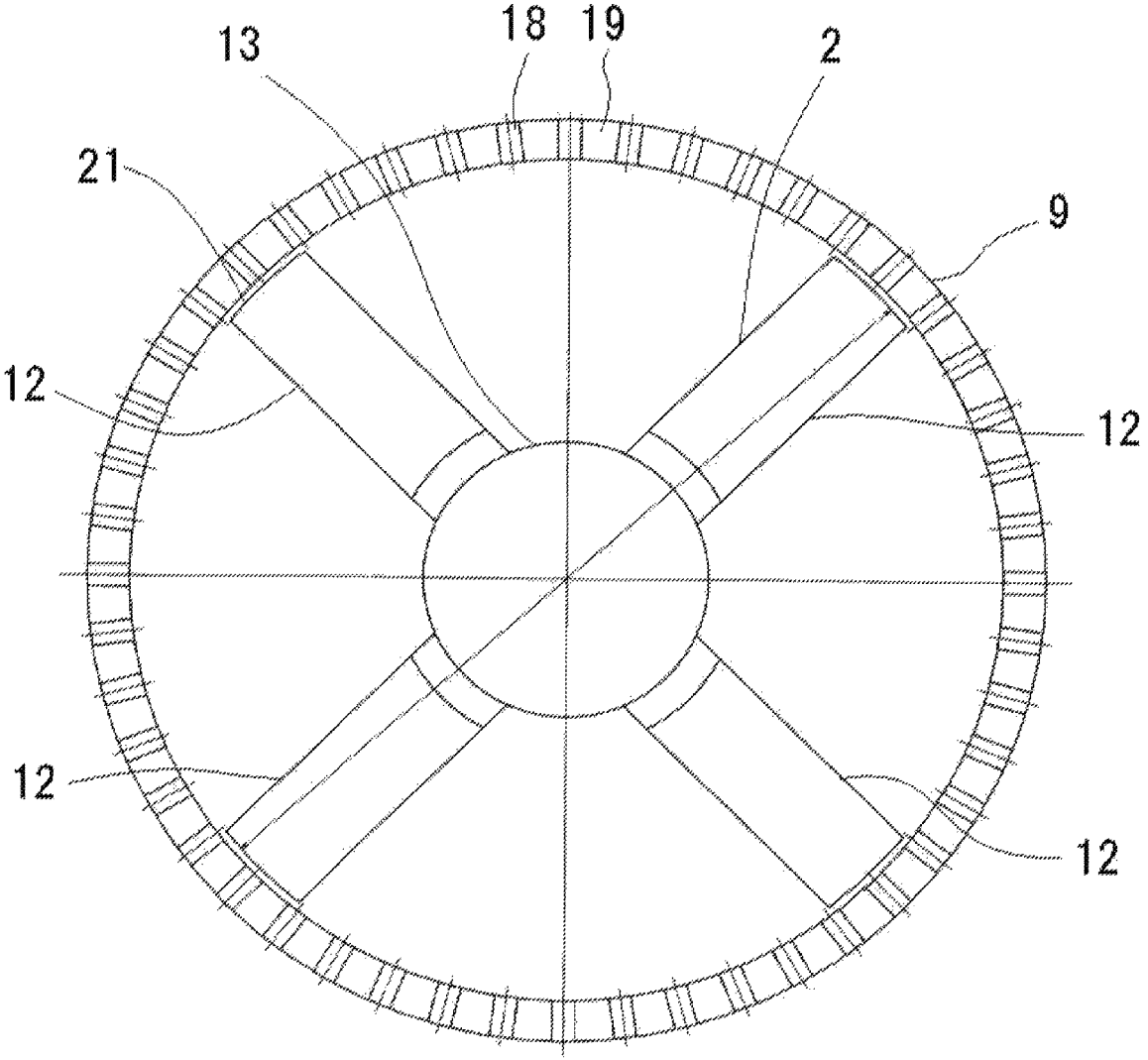

FIG. 7 This is the sectional view of the essential part of the said stirrer according to the embodiment in which the present invention is applied.

Figure 8:
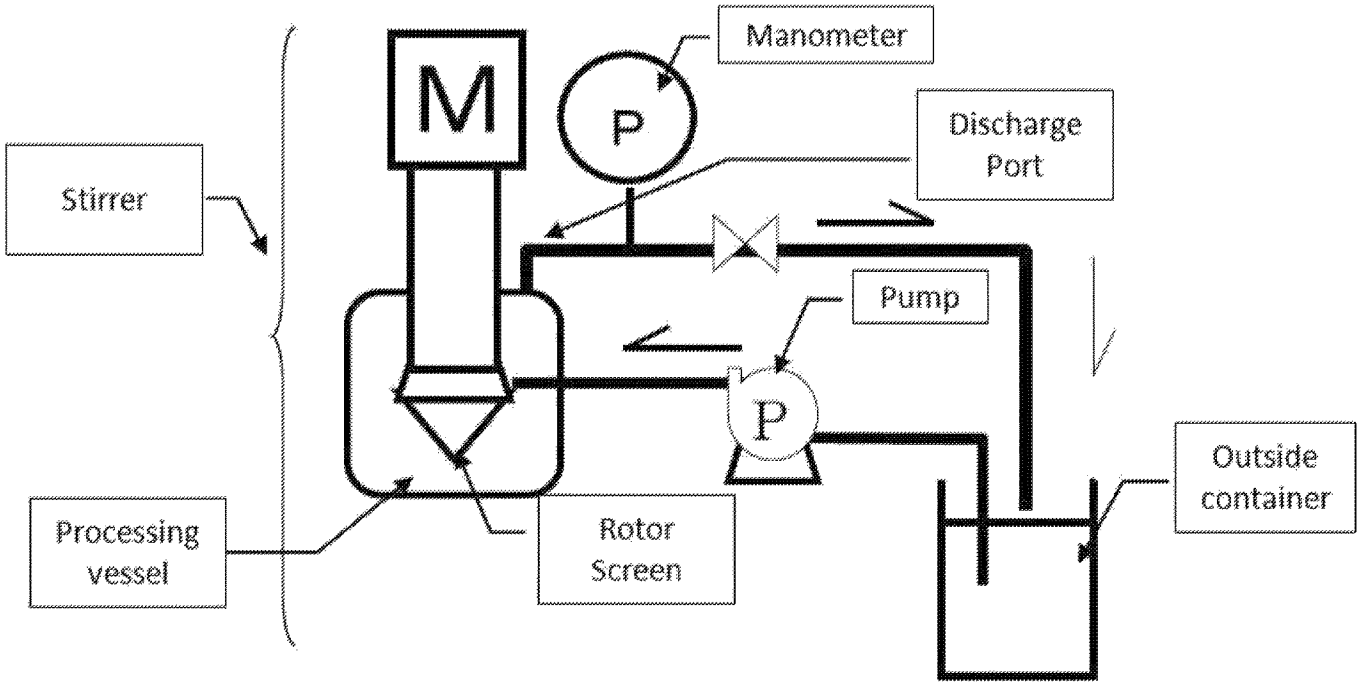

FIG. 8 This is the explanatory drawing of the experimental apparatus according to Examples and Comparative Examples of the present invention.

Figure 9:
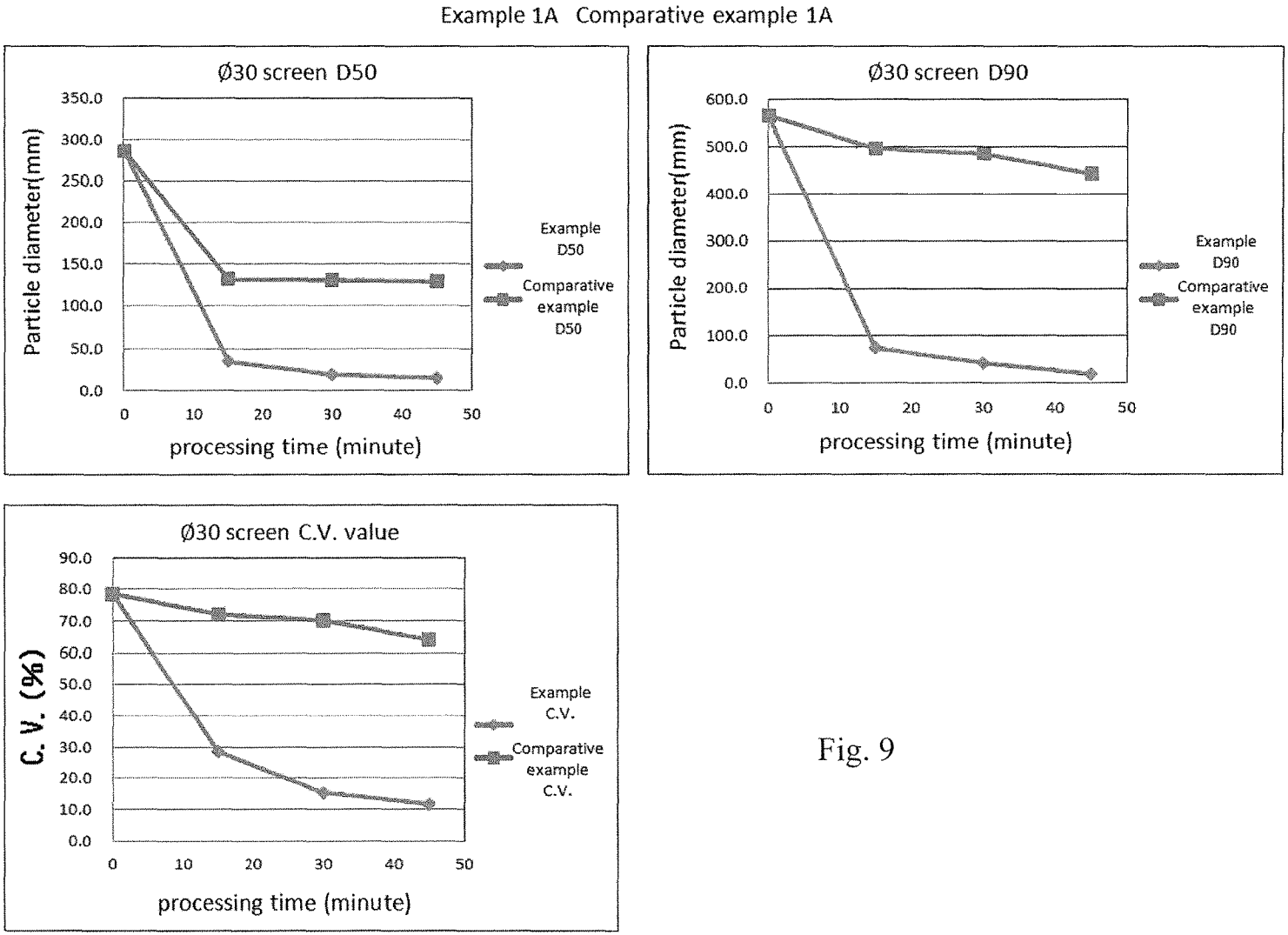

FIG. 9 This is the graph showing the experimental result of Examples 1A and Comparative Example 1A.

Figure 10:
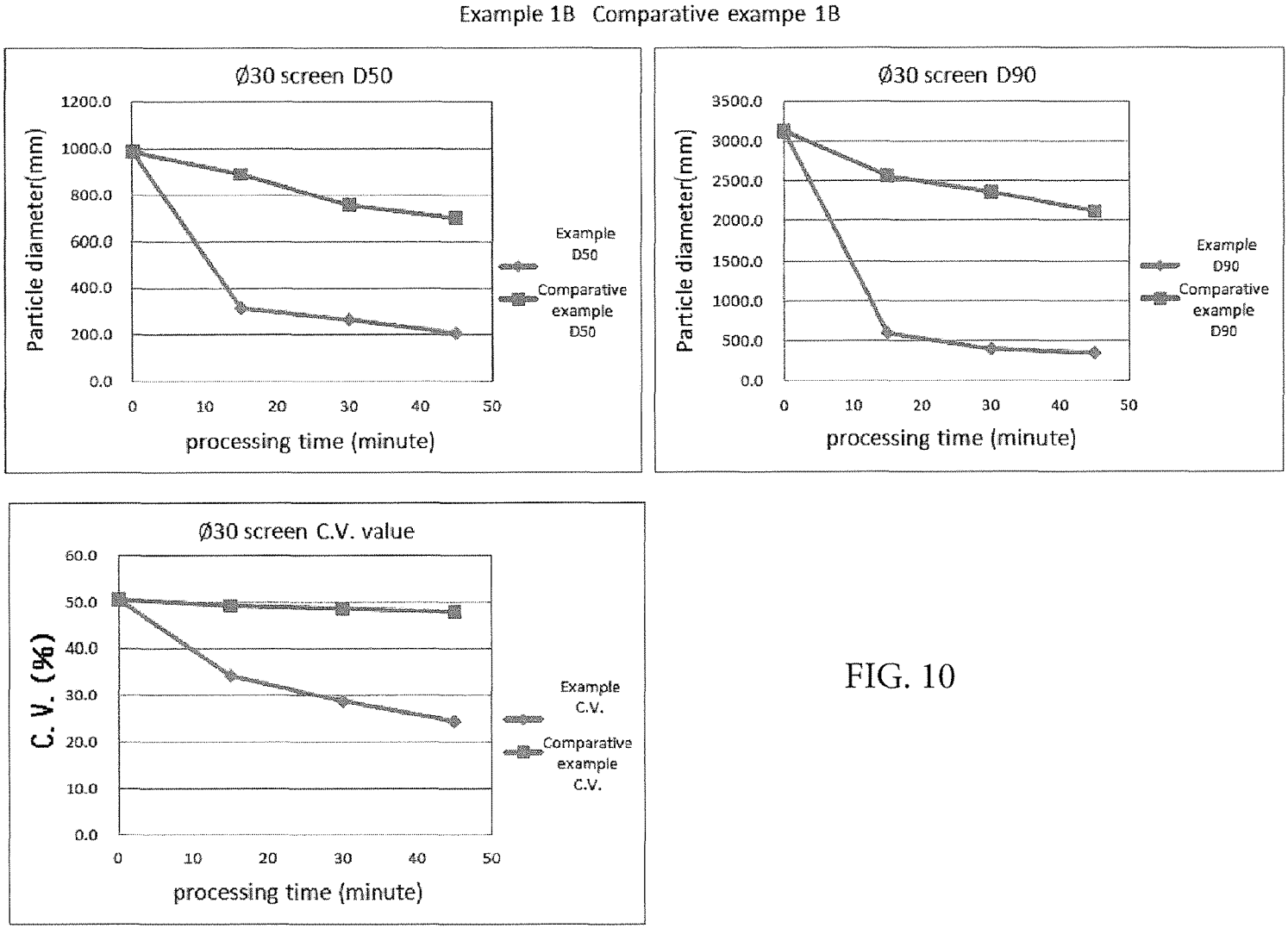

FIG. 10 This is the graph showing the experimental result of Examples 1B and Comparative Example 1B.

Figure 11:
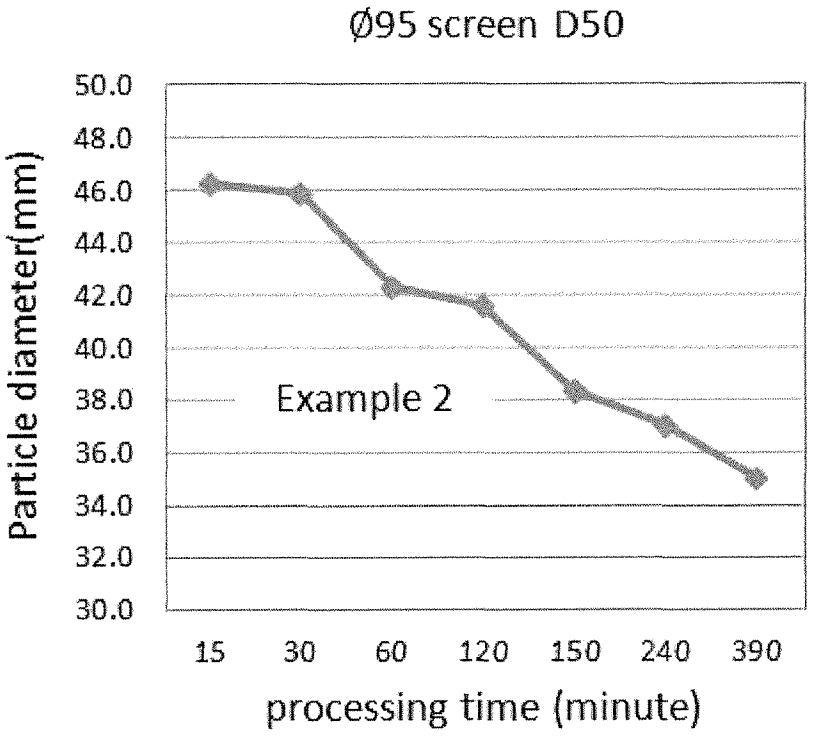
Figure 11:
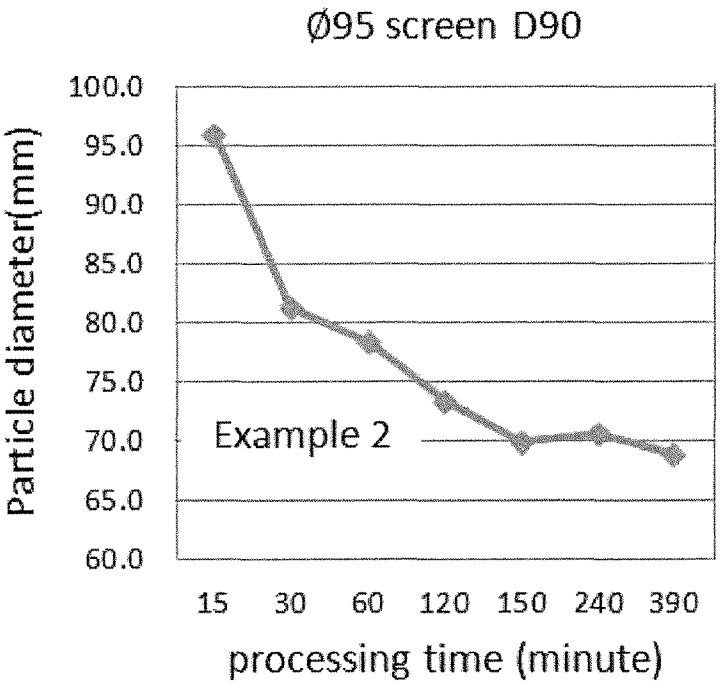

FIG. 11 This is the graph showing the experimental result of Example 2.

BEST MODES FOR CARRYING OUT THE INVENTION

Hereunder, the first embodiment of the present invention will be explained based on the drawings.

Firstly, with referring to FIG. 1 and FIG. 2, the basic structure of one example of the stirrer according to the present invention will be explained.

The stirrer according to this embodiment comprises the processing member 1 disposed in the fluid that will be subjected to the processing treatment such as emulsification, dispersion, and mixing and the rotor 2 disposed in the processing member 1.

The processing member 1 is a hollow housing, which is supported by the supporting tube 3 and is arranged either in the accommodating vessel 4 in which the fluid to be processed is accommodated or in the flow path of the fluid to be processed. In this embodiment, it is shown that the processing member 1 is arranged in the front end of the supporting tube 3 and is inserted from the upper side of the accommodating vessel 4 into the lower side therein; however this is not always the case, so that execution of the embodiment may also be possible in such away that the processing member 1 may be supported by the supporting tube 3 so as to be projected from the bottom of the accommodating vessel 4 toward the upper direction thereof, as shown in FIG. 3.

The processing member 1 comprises the sucking chamber 6 having the sucking port 5 through which the fluid to be processed is sucked into inside the chamber from the outside thereof, and the stirring chamber 7 that is connected through to the sucking chamber 6. The circumference of the stirring chamber 7 is stipulated by the screen 9 that has plural slits 8.

Meanwhile, in this specification, explanation will be made as to the screen 9 which is constituted by the slit 18, i.e., a space portion, and the screen member 19, i.e., an actual member located between the slits 18. Therefore, the screen 9 means the entirety including the slit 18 formed in plural screen members 19; and thus, the screen member 19 means each of actually existing members between the neighboring slits 18.

Between the sucking chamber 6 and the stirring chamber 7 is comparted by the comparting wall 10, and these compartments are connected through via the introduction opening 11 that is arranged in the comparting wall 10. However, the sucking chamber 6 and the comparting wall 10 are not essential; and thus, for example, the entirety of the upper part of the stirring chamber 7 may be the introduction opening without arranging the sucking chamber 6 whereby introducing the fluid to be processed in the accommodating vessel 4 directly into the stirring chamber 7, or alternatively the sucking chamber 6 and the stirring chamber 7 may form a configuration of one space in which these chambers are not comparted by the comparting wall 10.

The rotor 2 is a rotating body having plural blades 12 in the circumferential direction; and this rotates with keeping a very narrow clearance between the blades 12 and the screen 9. As to the mechanism to rotate the rotor 2, various rotation drive mechanisms may be used; and in this embodiment, the rotor 2 is arranged in the front end of the rotation axis 13, and this is accommodated in the stirring chamber 7 so as to be able to rotate. In more detail, the rotation axis 13 is inserted through the supporting tube 3 so as to go through the sucking chamber 6 and the opening 11 of the comparting wall 10 until the stirring chamber 7, and is provided with the rotor 2 in its front end (in the drawing, the lower end). The rear end of the rotation axis 13 is connected to the rotation drive mechanism such as the motor 14. The motor 14 is preferably subjected to the control of the control system such as the numerical control or a computer.

In this stirrer, during the time when the rotating blades 12 are passing the inner wall of the screen member 19 by rotation of the rotor 2, a shear force is applied to the fluid to be processed that is present between the blades and the wall whereby executing emulsification, dispersion, or mixing. At the same time with this, by rotation of the rotor 2, the kinetic energy is given to the fluid to be processed thereby accelerating the fluid to be processed while it is passing through the slits 18; and as a result, the fluid to be processed is discharged to outside the stirring chamber 7 while forming the intermittent jet flow. By this intermittent jet flow, the liquid-liquid shear force is also generated in the velocity interface whereby executing emulsification, dispersion, or mixing.

The screen 9 has a form of cylinder having a circular cross section. It is preferable that the screen 9 is made such that the diameter thereof becomes shorter as moving more apart from the introduction port 11 (in example of FIG. 2, as going downward), like a conical surface shape, for example.

If the diameter is made constant in the axial direction, the discharged amount from the slits 18 is larger in the part near to the introduction opening 11 (in FIG. 2, in the upper part), whereas the discharged amount is smaller in the part apart far from the opening (in FIG. 2, in the lower part). As a result, there is a risk of generating the uncontrollable cavitation which may cause a mechanical malfunction.

The slits 18 that are extended linearly to the direction of the rotation axis 13 (vertical direction in the example of the drawing) are shown; however, they may be extended spirally or with a curve. The shape of the slits 18 is not necessarily a narrow and long space; they may be in the shape of polygonal, circular, ellipse, or the like. In addition, although the slits 18 are formed in plural with the same intervals in the circumferential direction; however, they may be formed with putting off in the intervals, and besides, the slits 18 having plural shapes and sizes may not be excluded.

The slit 18 may be configured so as to have the lead angle variously changed. As illustrated in the drawing, the slit 18 may be configured so as to be linearly extended upward and downward with the lead angle of 90° between the plane perpendicular to the rotation axis 13 and the extending direction of the slit 18; or alternatively, the slit may be configured so as to be a spiral form having a prescribed lead angle, or so as to be extended upward and downward with a curve.

The blades 12 of the rotor 2 may be extended radially and linearly from the center of the rotor 2 with a constant width in the traverse sectional view (the cross section perpendicular to the axial direction of the rotation axis 13); or alternatively, they may become gradually wider in their sizes or may be warped as they are extending toward the outside.

Also, these blades 12 may have the lead angle of the edge portion 21 thereof arbitrarily changed. For example, the blade may be configured so as to be linearly extended upward and downward with the lead angle of 90° between the plane perpendicular to the rotation axis 13 and the extending direction of the edge portion 21; or alternatively, the blade may be configured so as to be a spiral form having a prescribed lead angle, or so as to be extended upward and downward with a curve.

The shape of these individual constituent members have a matching region where the edge portion of the blade 12 and the slit 18 are in the same position and overlapped with each other in the longitudinal direction of the slit 18. By rotation of the rotor 2, shearing of the fluid to be processed can be generated between the blade 12 and the screen member 19 in this matching region, and also, with rotation of the blade 12, a kinetic energy can be given to the fluid to be processed that goes through the slit 18 so as to generate the intermittent jet flow.

The clearance between the screen 9 and the blades 12 may be arbitrarily changed so far as the shear force and the jet flow as mentioned above can be generated; however, usually the clearance is preferably in the range of about 0.2 to 4.0 mm.

Also, in the case that, as shown in FIG. 2, the screen 9 having a tapered shape as a whole is used, this clearance can be readily controlled by making at least any one of the stirring chamber 7 and the rotor 2 movable in the axial direction.

With regard to other structure of the stirrer, the stirrers shown in FIG. 4 and FIG. 5 may also be employed.

In the example of FIG. 4, in order to make the entirety of the fluid to be processed in the accommodating vessel 4 uniform by stirring, a separate stirring equipment is installed in the accommodating vessel 4. Specifically, the stirring blade 15 to stir the entirety inside the accommodating vessel 4 may be installed such that it may rotate integrally with the stirring chamber 7. In this case, both the stirring blade 15 and the stirring chamber 7 including the screen 9 are rotated together. During this time, the directions of the rotations of the stirring blade 15 and of the stirring chamber 7 may be either as same as the direction of the rotation of the rotor 2 or opposite to it. That is, because rotation of the stirring chamber 7 including the screen 9 becomes slower relative to rotation of the rotor 2 (specifically the circumferential velocity of rotation of the screen is in the range of about 0.02 to 0.5 m/sec), this does not substantially influence the shear force and the jet flow.

In the example shown in FIG. 5, the stirring chamber 7 is made rotatable to the supporting tube 3, and the rotation axis of the second motor 20 is connected to the front end of the stirring chamber 7, so that the screen 9 is made rotatable at high rotation speed. The screen 9 is rotated in the direction opposite to the rotational direction of the rotor 2 disposed inside the stirring chamber 7. By so doing, the relative rotation velocity of the screen 9 to the rotor 2 is increased.

In the stirrer described above, the present invention is applied as follows. In the stirrer according to the present invention, the liquid-liquid shear force is generated in the velocity interface by the intermittent jet flow, and with this, processing of emulsification, dispersion, or mixing is conducted. At this time, in the stirrer according to the embodiment of the present invention, the rotor 2 and the screen 9, for example, as shown in FIG. 6(A), FIG. 6(B), and FIG. 7, may be used. In the rotor 2 and screen 9 of this example, in the matching region (namely, the edge portion 21 of the blade 12 and the slit 18 of the screen 9 are in the same position and overlapped with each other in the longitudinal direction of the slit 18) in which the shear action in the screen 9 can be expressed, the condition 1 and the condition 2 shown below are satisfied.

(Condition 1)

The relationship among the width (b) of the edge portion 21 of the blade 12 in a rotational direction, the width (s) of the slit 18 in a circumferential direction, and the width (t) of the screen member 19 in a circumferential direction satisfies the condition $b \geq 2s+t$. In other words, the width of the edge portion 21 of the blade 12 in the rotor 2 in the rotational direction is set larger than the distance between both edges of the neighboring two slits 18.

(Condition 2)

The relationship between the width (b) of the edge portion 21 of the blade 12 in a rotational direction and the maximum inner diameter (c) of the screen 9 satisfies the condition $b \geq 0.1c$. In other words, the ratio of the edge portion 21 of the blade 12 to the maximum inner diameter of the screen 9 is set so as to be larger than a prescribed value.

As mentioned above, the stirrer according to the presently applied invention satisfies both the condition 1 and the condition 2 in the matching region. With regard to the position of the rotation axis of the rotor 2 in the axial direction, any position may be allowed so far as it is in the matching region; however, it is preferable that both the condition 1 and the condition 2 are satisfied at least in the position where the position of the rotation axis 13 in the axial direction is the maximum inner diameter of the screen 9.

It was found that when the rotor 2 and the screen 9 satisfy these two conditions, this stirrer can increase the liquid-liquid shear force in the velocity interface, so that the stirrer is very effective in realization of very fine dispersion and emulsification such as nano-level dispersion and emulsification. On the basis of this finding, the present invention could be completed.

Explanation with regard to the action of the intermittent jet flow will be made with comparing to the conventional example shown in FIG. 6(C) and FIG. 6(D). Firstly, as mentioned before, the intermittent jet flow is generated by rotation of the blade 12. To explain this more specifically, the pressure of the fluid to be processed increases in the front side of the rotational direction of the blade 12. With this, the fluid to be processed is ejected as the intermittent jet flow from the slit 18 that is located in the front side of the blade 12. On the other hand, in the back side in the rotational direction of the blade 12, the pressure of the fluid to be processed decreases, so that the fluid to be processed is sucked from the slit 18 that is located in the back side of the blade. As a result of it, outside the screen 9, the forward flow and the backward flow (ejection flow and suction flow) are generated in the fluid to be processed; and thus, due to the relative difference in the velocities in the interface of the both flows, the liquid-liquid shear force is generated among the fluids to be processed.

In the conventional example shown in FIG. 6(C) and FIG. 6(D), because the width of the edge portion 21 of the blade 12 was narrow, it was difficult for the fluid to be processed to follow the change of the state between ejection and suction; and as a result, the relative difference in the velocities in the interface of the forward flow and the backward flow (ejection flow and suction flow) of the fluid to be processed was in a state of comparatively small, so that the shear force thereof was small, too.

On the other hand, in the embodiment of the present invention shown in FIG. 6(A) and FIG. 6(B), the width of the edge portion 21 of the blade 12 is wide, so that a period during which the fluid to be processed stays static between ejection and suction is generated. Because of this, the fluid to be processed can follow very well to the change of opening and closing of the slit 18 due to the blade 12, so that the relative difference in the velocities of the forward flow and the backward flow (ejection flow and suction flow) of the fluid to be processed in the interface thereof increases; and as a result, the shear force generated between the fluids to be processed can be increased. The conditions to favorably realize this are the condition 1 and the condition 2.

(With Regard to the Matching Region)

The edge portion 21 of the blade 12 and the slit 18 have at least the matching region in which they are in the same position and overlapped with each other in the longitudinal direction of the slit 18. Usually, the length of the blade 12 is set longer than the length of the slit 18, and thus, the entire length of the slit 18 is in the same position, where the blade 12 overlaps with the slit 18 with each other; however, the embodiment that the length of the blade 12 is shorter than the length of the slit 18 may also be allowed. In the present invention, when the relationship between the blade 12 and the slit 18 is stipulated, this refers to the relationship in the matching region unless explained otherwise.

(With Regard to the Screen)

As mentioned before, the embodiment wherein the screen 9 has the diameter thereof changed, like a tapered shape, etc., may also be allowed. In the present invention, in the case that the inner diameter is changed, the maximum inner diameter refers to the maximum diameter of the screen 9 in the matching region unless explained otherwise.

(With Regard to the Slit and the Screen Member)

The slit 18 may be extended parallel in the axial direction of the rotation axis of the rotor 2, or may be those having an angle to the axial direction, such as the one extended spirally. In any cases, in the present invention, the width (s) of the slit 18 in the circumferential direction refers to the length in the circumferential direction of the screen 9 (in other words, the direction perpendicular to the axial direction of the rotation axis of the rotor 2) in the matching region unless explained otherwise. In the axial direction of the rotation axis of the rotor 2, any position may be allowed so far as it is in the matching region; however, it is preferable that at least the position of the rotation axis 13 in the axial direction is the position of the maximum inner diameter of the screen 9. The width (s) of the slit 18 in the circumferential direction is preferably in the range of 0.2 to 4.0 mm, while more preferably in the range of 0.5 to 2.0 mm; however, this may be changed arbitrarily so far as the intermittent jet flow is generated.

The width (t) of the screen member 19 in the circumferential direction (in other words, the distance between the slits 18 that are located in a neighborhood to each other in the circumferential direction) may be arbitrarily changed; however, the width thereof is preferably 0.1 to 10 times, while more preferably about 0.5 to 2 times, as much as the width (s) of the slit 18 in the circumferential direction. If the width (t) of the screen member 19 in the circumferential direction is too wide, the number of the shearing decreases thereby leading to decrease in the throughput, while if the said width is too narrow, it may lead to substantially the same situation as the situation that the slits 18 are continuous, or it can cause significant decrease in a mechanical strength thereof.

(With Regard to the Rotor)

As mentioned before, the rotor 2 is a rotating body having plural blades 12. By making the edge portion 21 of the blade 12 satisfy the condition 1 and the condition 2 in the matching region, the action effect of the present invention can be expressed. Meanwhile, if the width of the edge portion 21 of the blade 12 is made too wide, the space volume between the blade 12 and the blade 12 becomes too small, so that it can cause a problem such as a unnecessarily decrease in the throughput. Considering this aspect, though different depending on the inner diameter of the screen 9, in rotor 2, in the region defined by the outer circumferential surface of the rotation axis 13 and the inner circumferential surface of the screen 9, it is preferable to set the total sum of the cross section area of the blades 12 in the plane perpendicular to the rotation axis 13 be smaller than the cross section area of the space inside the screen 9. As described before, in the matching region, when the total sum of the cross section area of the blades 12 in the plane perpendicular to the rotation axis 13 is represented by Y in the following specific formulas 1 and 2, and similarly, when in the matching region, the cross section area of the space inside the screen 9 in the plane perpendicular to the rotation axis 13 is represented by Z in the following specific formulas 1 and 2, it is preferable that Y and Z satisfy the specific formula 2. X in the specific formula 1 represents, in the matching region, the cross section area perpendicular to the rotation axis in the region defined by the outer circumferential surface of the rotation axis 13 and the inner circumferential surface of the screen 9.

$$X-Y=Z \quad \text{(Specific Formula 1)}$$

$$Y<Z \quad \text{(Specific Formula 2)}$$

It is preferable that, of plural cross sections in the matching region, at least one cross section satisfy the specific formula 2, while more preferably all the cross sections satisfy the specific formula 2. And, as shown in FIG. 2, when the screen 9 whose diameter becomes gradually shorter as moving more apart from the introduction port 11 (in example of FIG. 2, as going downward) is used, and also the position of the plane in the axial direction perpendicular to the rotation axis 13 is the position of the maximum inner diameter of the screen 9 in the matching region, Y/Z is preferably in the range of 0.2 or more to less than 1, more preferably in the range of 0.34 to 0.6 (both ends inclusive), while still more preferably in the range of 0.34 to 0.5 (both ends inclusive). Y/Z can be calculated on the basis of the diameter of the rotation axis 13, the diameter of the blade 12, the width of the blade 12 in the rotational direction, the inner diameter of the screen 9, and so forth.

(Preferable Use Conditions)

The numerical conditions of the screen 9, the slit 18, and the rotor 2, which can apply the condition 1 and the condition 2 of the present invention and are considered to be suitable for mass production by the today's technology, are as follows.

Maximum inner diameter of the screen 9: 30 to 500 mm (however, maximum diameter in the matching region)

Rotation number of the screen 9: 15 to 390 rotations/second

Number of the slit 18: 20 to 500

Maximum outer diameter of the rotor 2: 30 to 500 mm

Rotation number of the rotor 2: 15 to 390 rotations/second

As a matter of course, these numerical conditions show one example; and as the technologies such as rotation control, etc., advances in future, the present invention does not preclude to employ the conditions other than the above conditions.

EXAMPLES

Hereunder, the present invention will be explained further specifically by showing Examples. However, the present invention is not limited to the following Examples.

Example 1 and Comparative Example 1

As Example 1 (namely, Example 1A and Example 1B) and Comparative Example 1 (namely, Comparative Example 1A and Comparative Example 1B), two kinds of the fluid to be processed were processed for testing (Example 1A/Comparative Example 1A, and Example 1B/Comparative Example 1B) by using the stirrer according to the first embodiment of the present invention (FIG. 1 and FIG. 2).

In Example 1A/Comparative Example 1A in which pigment was subjected to the dispersion processing, copper phthalocyanine/sodium dodecylsulfate/pure water=2/0.2/97.8 (weight ratio) was used as the fluid to be processed.

In Example 1B/Comparative Example 1B in which resins were subjected to the emulsification processing, methyl methacrylate monomer/Aqualon KH-10/pure water=10/1/89 (weight ratio) was used as the fluid to be processed. However, Aqualon KH-10 is a surfactant manufactured by DKS Co., Ltd.

By using a pump in the test equipment shown in FIG. 8, the fluid to be processed of the preliminary mixture stored in the outside vessel (1-L tall beaker equipped with a stirrer) was introduced into the processing vessel (350 cc) having the stirrer, and the processing vessel was completely filled with the liquid; and the fluid to be processed was introduced into the processing vessel by means of the pump, whereby ejecting the fluid to be processed from the ejection port to carry out the processing to refine the particles with ejecting the fluid from the screen by rotating the rotor of the stirrer at the rotation speed of 20000 rpm while circulating the fluid between the processing vessel and the outside vessel under the condition shown in Table 1. Meanwhile, in all examples, the screen was not rotated.

The width of the slit and the width of the screen member shown in Table 1 are the width of the slit and the width of the screen member at the position where the plane perpendicular to the rotation axis 13 in the axial direction is the maximum inner diameter of the screen 9 in the matching region.

In Example 1, both the condition 1 and the condition 2 were satisfied; on the contrary, in Comparative Example 1, neither the Condition 1 nor the Condition 2 was satisfied.

Example 1

$$3.6>2\times0.8+1.19=2.79 \quad \text{(Condition 1)}$$

$$3.6>0.1\times30.4=3.04 \quad \text{(Condition 2)}$$

Comparative Example 1

$$2.4<2\times0.8+1.19=2.79 \quad \text{(Condition 1)}$$

$$2.4<0.1\times30.4=3.04 \quad \text{(Condition 2)}$$

With regard to Example 1 and Comparative Example 1, particle diameters (D50 and D90) of the particle as well as coefficient of variation (C. V.) of the particle diameter measured at several time points till the maximum processing time of 45 minutes are shown in FIG. 9 and FIG. 10. The coefficient of variation of the particle diameter is an indicator to show the evenness of the obtained particles; and this coefficient can be obtained from the average particle diameter (D50) in the particle diameter distribution of the particle and the standard deviation with the formula: Coefficient of Variation (C. V.) (%)=Standard Deviation≥Average Particle Diameter (D50)×100. When the value of this coefficient of variation becomes smaller, distribution of the particle diameter of the obtained particles becomes narrower, namely, the particles become higher in its evenness.

From FIG. 9 and FIG. 10, it becomes clear that in Example 1, the particle diameter and the coefficient of variation of the particle diameter decrease more significantly with elapse of the processing time as compared with Comparative Example 1.

Example 2

Next, even when the rotor and the screen having larger diameter than those of Example 1 were used in Example 2, it was confirmed whether or not the particle diameter significantly decreases with elapse of the processing time. The processing conditions are shown in Table 1, and the test results are shown in FIG. 11, respectively. The processing equipment was substantially the same as those of Example 1, except that the whole equipment was made larger in accordance with the throughput (outer vessel: 300-L tank equipped with a stirrer, processing vessel: 8.5 L). With regard to the fluid to be processed, dextrin was used as the component to be refined, and a plant oil was used as the dispersion medium.

In Example 2, too, as can be clearly seen in Table 1, both the condition 1 and the condition 2 were satisfied.

Example 2

$$11.3>2\times1.1+1.90=4.10 \quad \text{(Condition 1)}$$

$$11.3>0.1\times95.4=9.54 \quad \text{(Condition 2)}$$

From FIG. 11, it becomes clear that in Example 2, too, the particle diameters (D50 and D90) are significantly decreased with elapse of the processing time.

TABLE 01

| | Example 1A | Comparative Example 1A | Example 1B | Comparative Example 1B | Example 2 |
|---|---|---|---|---|---|
| Screen nominal diameter | Ø30 | Ø30 | Ø30 | Ø30 | Ø95 |
| Maximum inner diameter of the screen (at a part having slits) (mm) | 30.4 | 30.4 | 30.4 | 30.4 | 95.4 |
| width of a slit (mm) | 0.8 | 0.8 | 0.8 | 0.8 | 0.8 |
| number of slits | 48 | 48 | 48 | 48 | 100 |
| lead angle of a slit (°) | 90 | 90 | 90 | 90 | 90 |
| Width of a screen member (distance between neighboring screen) (mm) | 1.19 | 1.19 | 1.19 | 1.19 | 1.90 |
| number of blades | 4 | 6 | 4 | 6 | 4 |
| width of a blade tip (mm) | 3.6 | 2.4 | 3.6 | 2.4 | 11.3 |
| blade rotation number (rpm) | 20000 | 20000 | 20000 | 20000 | 5700 |

TABLE 01-continued

| | Example 1A | Comparative Example 1A | Example 1B | Comparative Example 1B | Example 2 |
|---|---|---|---|---|---|
| lead angle of a blade (°) | 90 | 90 | 90 | 90 | 90 |
| fluid to be processed | copper phthalocyanine/sodium dodecylsulfate/pure water = 2/0.2/97.8 (weight ratio) | copper phthalocyanine/sodium dodecylsulfate/pure water = 2/0.2/97.8 (weight ratio) | copper phthalocyanine/sodium dodecylsulfate/pure water = 2/0.2/97.8 (weight ratio) | copper phthalocyanine/sodium dodecylsulfate/pure water = 2/0.2/97.8 (weight ratio) | component to be refined:dextrin dispersion medium:plant oil |
| throughput (Kg) | 2.0 | 2.0 | 2.0 | 2.0 | 126.5 |
| circulating amount (L/min.) | 3.1 | 3.1 | 6.0 | 6.0 | 17 |
| processing duration (min.) | 45 | 45 | 45 | 45 | 390 |
| processing temperature (° C.) | 19 to 22 (room temperature) | 19 to 22 (room temperature) | 15 to 18 (room temperature) | 15 to 18 (room temperature) | 10 to 24 (room temperature) |

REFERENCE NUMERALS

1. Processing member
2. Rotor
3. Supporting tube
4. Accommodating vessel
5. Sucking port
6. Sucking chamber
7. Stirring chamber
9. Screen
10. Comparting wall
11. Opening
12. Blade
13. Rotation axis
14. Motor
15. Stirring blade
18. Slit
19. Screen member
20. Second motor
21. Edge portion

The invention claimed is:

1. A stirrer comprising:

a supporting tube;

a hollow housing supported by the supporting tube, the hollow housing including a sucking chamber and a sucking port, wherein the hollow housing is configured to suck a fluid to be processed into the sucking chamber via the sucking port then to introduce it to a stirring chamber via a comparting wall;

a rotating rotor provided with a plurality of blades and accommodated in the stirring chamber; and a screen arranged around the rotor, wherein the screen is tapered towards a central axis of the supporting tube and is arranged around the rotor;

wherein:

the rotor and the screen are provided within the hollow housing, each blade includes an edge portion at an outermost circumferential surface thereof, the screen comprises a plurality of slits in a circumferential direction thereof and a screen member located between the slits that are located in a neighborhood to each other, a clearance from the edge portion of each blade to the screen is a constant value, the edge portion of each blade and each slit have a matching region where they are in the same position and overlapped with each other in a longitudinal direction of the respective slit, of the rotor and the screen, at least the rotor is rotated so as to relatively rotate the rotor and the screen thereby ejecting a fluid to be processed in the stirring chamber from inside the screen to outside thereof through the slits as an intermittent jet flow, and the stirrer satisfies following condition 1 and condition 2:

(Condition 1)

in the matching region, a relationship among a width (b) of the edge portion of each blade in a rotational direction, a width (s) of the respective slit in a circumferential direction, and a width (t) of the screen member in a circumferential direction is shown by $b \geq 2s+t$, and (Condition 2)

in the matching region, a relationship between the width (b) of the edge portion of each blade in a rotational direction and a maximum inner diameter (c) of the screen is shown by $b \geq 0.1c$.

2. The stirrer according to claim 1, wherein the width of the slits in a circumferential direction is in a range of 0.2 to 4.0 mm.

3. The stirrer according to claim 1, wherein diameters of each blade and the screen become shorter as each blade and the screen are more apart in an axial direction from an introduction port to introduce the fluid to be processed from the sucking chamber into the screen.

4. The stirrer according to claim 1, wherein:

the plurality of the slits have an identical width in the circumferential direction and are formed with an identical interval in the circumferential direction, and the screen does not rotate.

5. The stirrer according to claim 1, wherein a total sum of a cross section area of the plurality of blades in a plane perpendicular to a rotation axis of the rotor is smaller than a cross section area of a space inside the screen.

6. The stirrer according to claim 1, wherein the comparting wall is provided between the sucking port and the plurality of blades, and wherein the comparting wall extends towards the rotor.

7. The stirrer according to claim 1, wherein the sucking port is tapered away from the central axis of the supporting tube.

8. The stirrer according to claim 1, wherein the clearance is between an inner wall of the screen and the edge portion of each blade and is in the range of 0.2 to 4.0 mm, and wherein a fluid to be processed is ejected, as the intermittent jet flow, from inside the screen to outside thereof through the slits located in a front side of the rotational direction of each blade and the fluid to be processed is sucked through the slits located in a back side of the rotational direction of each blade, the stirrer being configured to generate a period between ejection from the slits located in the front side of the rotational direction of each blade and suction from the slits located in the back side of the rotational direction of each blade, where the fluid to be processed becomes static by setting the clearance.

9. A stirrer comprising:

a supporting tube;

a hollow housing supported by the supporting tube, the hollow housing including a sucking chamber and a sucking port, wherein the hollow housing is configured to suck a fluid to be processed into the sucking chamber via the sucking port then to introduce it to a stirring chamber via a comparting wall;

a rotating rotor provided with a plurality of blades and accommodated in the stirring chamber; and a screen arranged around the rotor, wherein the screen is tapered towards a central axis of the supporting tube and is arranged around the rotor;

wherein:

the rotor and the screen are provided within the hollow housing, each blade includes an edge portion at an outermost circumferential surface thereof, the screen comprises a plurality of slits in a circumferential direction thereof and a screen member located between the slits that are located in a neighborhood to each other, the edge portion of each blade and each slit have a matching region where they are in the same position and overlapped with each other in a longitudinal direction of the respective slit, the rotor is rotated and the screen is rotated in an opposite direction to the rotor thereby ejecting a fluid to be processed in the stirring chamber from inside the screen to outside thereof through the slits as an intermittent jet flow, and the stirrer satisfies following condition 1 and condition 2:

(Condition 1)

in the matching region, a relationship among a width (b) of the edge portion of each blade in a rotational direction, a width (s) of the respective slit in a circumferential direction, and a width (t) of the screen member in a circumferential direction is shown by $b \geq 2s+t$, and (Condition 2)

in the matching region, a relationship between the width (b) of the edge portion of each blade in a rotational direction and a maximum inner diameter (c) of the screen is shown by $b \geq 0.1c$.

10. The stirrer according to claim 9, wherein the width of the slits in a circumferential direction is in a range of 0.2 to 4.0 mm.

11. The stirrer according to claim 9, wherein diameters of each blade and the screen become shorter as each blade and the screen are more apart in an axial direction from an introduction port to introduce the fluid to be processed from the sucking chamber into the screen.

12. The stirrer according to claim 9, wherein:

the supporting tube includes a stirring blade located on an outer circumferential surface thereof, the plurality of the slits have an identical width in the circumferential direction and are formed with an identical interval in the circumferential direction.

13. The stirrer according to claim 9, wherein a total sum of a cross section area of the plurality of blades in a plane perpendicular to a rotation axis of the rotor is smaller than a cross section area of a space inside the screen.

14. The stirrer according to claim 9, wherein the comparting wall is provided between the sucking port and the plurality of blades, and wherein the comparting wall extends towards the rotor.

15. The stirrer according to claim 9, wherein the sucking port is tapered away from the central axis of the supporting tube.

16. The stirrer according to claim 9, wherein a clearance between an inner wall of the screen and the edge portion of each blade is in the range of 0.2 to 4.0 mm, and wherein a fluid to be processed is ejected, as the intermittent jet flow, from inside the screen to outside thereof through the slits located in a front side of the rotational direction of each blade and the fluid to be processed is sucked through the slits located in a back side of the rotational direction of each blade, the stirrer being configured to generate a period between ejection from the slits located in the front side of the rotational direction of each blade and suction from the slits located in the back side of the rotational direction of each blade, where the fluid to be processed becomes static by setting the clearance.

* * * * *